US009713833B2

(12) United States Patent
Shirazi et al.

(10) Patent No.: US 9,713,833 B2
(45) Date of Patent: Jul. 25, 2017

(54) HYDRO IRONING

(71) Applicants: Ahmad Shirazi, Azadshahr (IR); Karen Abrinia, Tehran (IR)

(72) Inventors: Ahmad Shirazi, Azadshahr (IR); Karen Abrinia, Tehran (IR)

( * ) Notice: Subject to any disclaimer, the term of this patent is extended or adjusted under 35 U.S.C. 154(b) by 0 days.

(21) Appl. No.: 14/859,301

(22) Filed: Sep. 20, 2015

(65) Prior Publication Data

US 2017/0080473 A1 Mar. 23, 2017

(51) Int. Cl.

| | |
|---|---|
| ***B21D 9/15*** | (2006.01) |
| ***B21D 26/02*** | (2011.01) |
| ***B21D 26/027*** | (2011.01) |
| ***B21D 22/20*** | (2006.01) |
| ***B21D 39/08*** | (2006.01) |

(52) U.S. Cl.
CPC ..... *B21D 26/027* (2013.01); *B21D 22/205* (2013.01); *B21D 39/08* (2013.01)

(58) Field of Classification Search
CPC ..... B21D 26/027; B21D 22/205; B21D 39/08
USPC ..... 72/57, 347
See application file for complete search history.

(56) References Cited

U.S. PATENT DOCUMENTS

| | | | | |
|---|---|---|---|---|
| 3,769,824 A * | 11/1973 | Granzow | B21D 22/20 | 72/350 |
| 4,314,468 A * | 2/1982 | Baril | B21D 22/205 | 72/341 |
| 4,472,955 A * | 9/1984 | Nakamura | B21D 22/205 | 72/347 |
| 7,313,939 B2 * | 1/2008 | Nobata | B21D 22/205 | 29/421.1 |
| 8,756,970 B2 * | 6/2014 | Golovashchenko | B21D 24/04 | 72/351 |

OTHER PUBLICATIONS

Kampus et al; Analysis of the factors influencing the geometrical shape of workpieces produced by ironing,Journal of Materials Processing Technology, 49 (1995) 313-332.
Ironing (wall ironing), in: Metal Forming Practise, Springer Berlin Heidelberg, 2006, pp. 91-94.
Kampus et al, Improving workability in ironing, Journal of Materials Processing Technology, 130-131 (2002) 64-68.
Huang et al, An elasto-plastic finite element and experimental study of the ironing process, Journal of Materials Processing Technology, 26 (1991) 53-80.
Zhang et al, Recent developments in sheet hydroforming technology, Journal of Materials Processing Technology, 151 (2004) 237-241.

* cited by examiner

*Primary Examiner* — David B Jones
(74) *Attorney, Agent, or Firm* — Azadeh Saidi

(57) ABSTRACT

In the proposed hydro ironing method, through an innovative arrangement of loads and using a novel configuration for the die components, the thickness reduction in one stage of ironing is almost equal to twice the common approaches.

2 Claims, 7 Drawing Sheets

HYDRO IRONING

BACKGROUND OF INVENTION

The ironing process is used in the industry to reduce the thickness of deep drawn products and increase their height in such products as beverage cans, precision tubes and so forth. It could also be used in manufacturing sheet and bulk products with precise dimensions and smooth surfaces like in hole flanging and gear surface smoothing).

Thin high-walled components are difficult to be produced by deep drawing. For example any occasional inhomogeneity in the material properties and/or in its geometry promotes premature rupture instability. So, the deep drawing operation could be performed more safely on a thicker blank and with a modest drawing ratio, and later preformed cups would be significantly deepened by ironing.

In this way, stronger cups with more dimensional accuracy and surface smoothness would be produced. The extent to which products are deepened in each stage of ironing process depends on the amount of reduction in thickness achievable in that particular stage. Thus, when considerable rise in height is required, there will be a need for a high reduction in thickness which will call for a variety of dies and raise the manufacturing expenses.

In conventional ironing processes only a fraction of cup wall thickness is reduced. As a result, in order to reach to high reductions in thickness, several ironing stages are needed and the workpiece must go through several cleaning, heat treatment and lubrication stages.

Many efforts were done over the years to improve the ironing process. Some of them evaluated process parameters through numerical and experimental investigations to reach optimum final results. For example, a computer-aided model of ironing offered by Kampus was used to investigate the effects of process parameters on inner and outer diameter of workpiece.

Huang also used a finite-element method to study ironing and offered some considerations for die design. In another effort, Van der Aa presented graphs for the ironing process of polymer coated sheet metals. Another effort was due to Folle in which he studied the manufacturing process of beverage cans. He studied the influence of parameters such as the angle of the ironing die, friction coefficient and the clearance between the punch and ironing die on the ironing force.

Using the conventional ironing process, only a fraction (30% for aluminum and 36% for steel) of cup wall thickness is reduced. Therefore, there were several suggestions in previous works to overcome the problem of low reduction ratio in the ironing process. Using several rings arranged one after the other would be the first action that raises the thickness reduction by approximately 12%. Another way offered by Kampuš et al. is by using an imposed force on the cup edge for better leading of the material to forming zone.

Besides, increasing the friction between the punch and the product is another frequently suggested way for enhancing the reduction in thickness. This increased friction will transfer more traction from the punch to the product by interfacial shear. Based on this suggestion, the punch load acting on the bottom of the cup (at a given reduction) is reduced, thereby allowing higher reductions before the onset of rupture in the ironed wall.

One of the efficient ways of reaching such an increase in friction would be by applying a fluid pressure on the specimen. The latter way is frequently used in sheet forming processes, notably in deep drawing, to increase the process efficiency. Nonetheless, supplying the high pressures during the process is a great concern, technically and economically. So, it is worthwhile to go after new hydro mechanical tooling to overcome the expenses of high pressure equipment.

Studies on using fluid pressure in the ironing process are not as vast as that of deep drawing process. Tirosh et al offered a method in which a fluid pressure surrounded the cup on the mandrel. This pressure theoretically increased the frictional shear on cup-mandrel interface and also pushed the edge of the cup to forming zone. This resulted in an increase in the thickness reduction in the ironing process.

But the problem is that in practice, the fluid will be in contact with both sides of the specimen. So, the cup-punch interface will become lubricated during the process which is a basic drawback in the ironing process. Moreover, the fluid pressure will act on both sides of the specimen wall and as a result it cannot have a significant effect on increasing the friction on cup-punch interface.

Therefore, only the backward fluid pressure on the specimen edge would be helpful for increasing workability of the material. Thus, huge pressures (6000 bar for 60% reduction in steel specimens) are needed in order to significantly increase the workability of the material.

SUMMARY OF INVENTION

In the proposed hydro ironing process, the above mentioned problems are overcome. Also, the designed tooling will allow using drastically lower pressures (150 bare for 70% reduction in aluminum specimens) for reaching a certain reduction in thickness in comparison with the previous work. In addition, this tooling will accommodate thin-walled components with convex features on their walls where needed.

As a result of this invention, fewer tools and operators are needed and therefore pollution and energy consumption will be reduced. This reduction in thickness could be even enhanced by using optimum values of load and pressure for desired reductions. Another usage of this process is that some convexities could be made on external surfaces of the thin-walled components. These convexities could act as functional or assembly features.

Hydro ironing is the practical extension of hydro forming technique to the ironing process. Through a new tooling configuration in the hydro ironing process, a fluid pressure (P) and an axial imposed force (Loader force, FIG. 1) are simultaneously applied on cup wall. This will drastically improve workability of the material. The imposed axial stress assists the fluid pressure in forming the workpiece, but it is independent of the fluid pressure and can reach up to four or more folds. This would be a great economical advantageous since it will make it possible to use lower pressures and thus less expensive equipment.

The improvement in workability of material will result in fewer stages of ironing for achieving a certain thickness reduction. In practice, a number of strokes through dies of decreasing diameter are needed when the required thickness reduction is about 90 percent. The number of ironing stages would be equal to almost six in common ironing process (36% reduction permissible for steel)).

In such a multi-stage ironing process, it is generally necessary to anneal the workpiece, between stages, to remove hardening and recover plasticity and also there is a need for cleaning and re-lubricating of specimens. Thus other factors such as pollution and energy consumption are involved, in addition to an increase in the number of stages of deformation which calls for additional tooling and operators. On the other hand, by using hydro ironing process, only two stages would be needed for reaching a similar reduction in thickness.

This improvement in workability of material also is beneficiary for materials with low ductility. That is because the nature of the forming process is compressive and the tension in deformed wall is controllable. Materials with low resistance to tension could be formed easily through this process. In addition, since the plastic deformation of products is severe in this process, generally their mechanical properties like hardness and tensile strength will improve drastically.

Another point that deserves some attention is the ability of this process for making convex features (50 and 55), in the outer surfaces of hydro ironed components. As the deformed material remains stationary in contact with the inner surface of the die when it exits from the forming zone, if some concavities, e.g. indents or threads, are formed on die's inner surface, the counterpart convexities will be formed on the product's outer surface.

These features can act as functional parts like indents in drum clutches or as parts used for simplifying the assembly of products like threads or features produced in bulging and curling.

DETAILED DESCRIPTION OF SPECIFICATION

Figure 1:
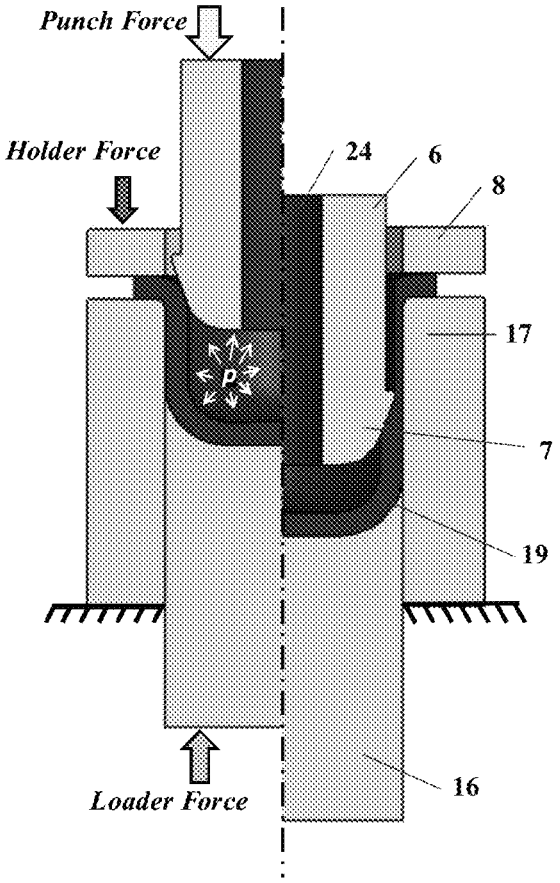
FIG. 1, displays a schematic illustration of main parts and applied forces.

Designed Tooling and Test Procedure:

A schematic illustration of main parts and applied forces are shown in FIG. 1. At the beginning of the process, a deep drawn cup 19 is put into the die 17 and the ironing ring 7 is set on the cup edge 38 while the cup edge is held by holder 8. At the same time a part named "Loader" 16 which is set on jack rod 11 applies an axial force to the cup bottom while a hydrostatic oil pressure is applied to the inner surface of the drawn cup. The ironing process begins from the edge of the cup. This tool configuration makes it easy to apply hydro static oil pressure (P, FIG. 1) to the inner surface of the cup, eliminating the need for sealing of oil and the need for a containing chamber.

Figure 5:
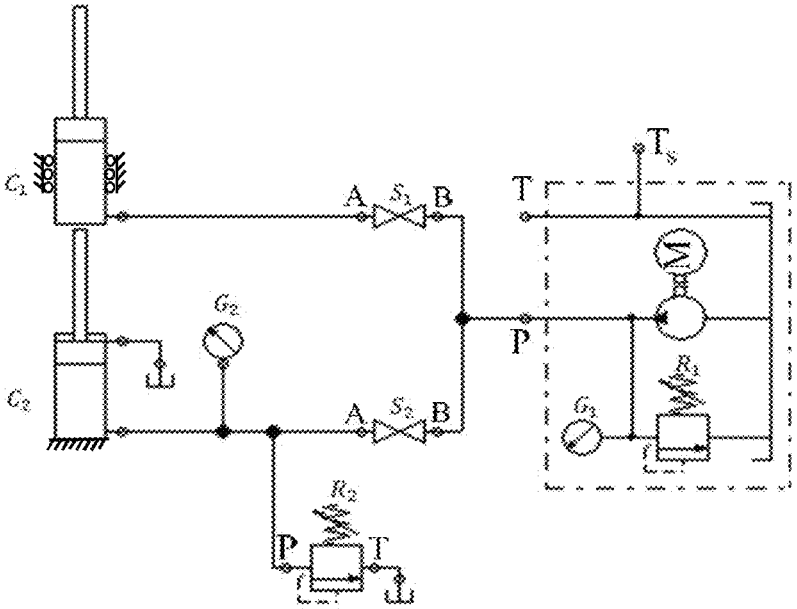
FIG. 5, displays hydraulic circuit used in hydro ironing process.

The ring 7 comes down and establishes a pressing contact with the cup wall (FIG. 1, left). Then the cup is filled with the oil coming from the central hole 24 of the mandrel 6 and its pressure reaches to a pressure which is preset on $R_1$ (FIG. 5). The pressure at ring-cup interface prevents the oil leakage. Afterward, the ring 7 comes down (FIG. 1, right) until it touches the cup bottom.

Meanwhile, Loader 6 applies a constant force, which is defined by preset pressure on $R_2$ (FIG. 5). After the ironing stage, the ring comes out of the cup while the cup edge is unloaded and there is still a low pressure (set by $R_1$) in the cup. Then, loader comes back to its former place, expels the formed specimen and would be ready for putting the next specimen.

Figure 2:
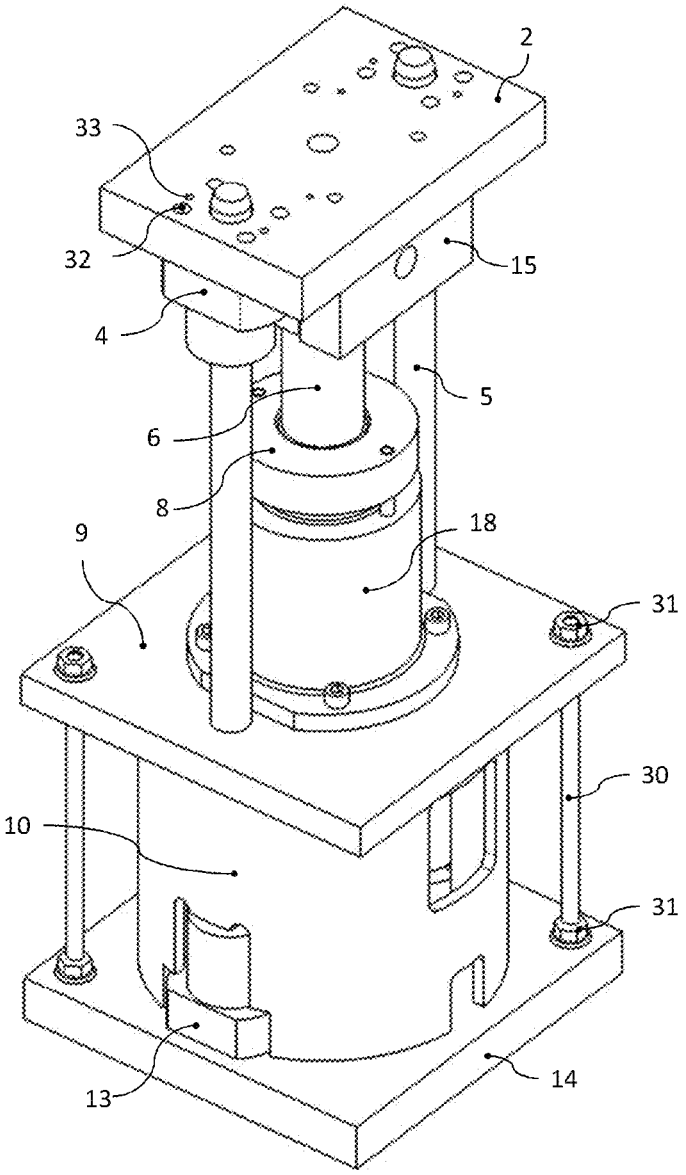
FIG. 2, displays an isometric view of designed hydro ironing tooling.
Figure 3:
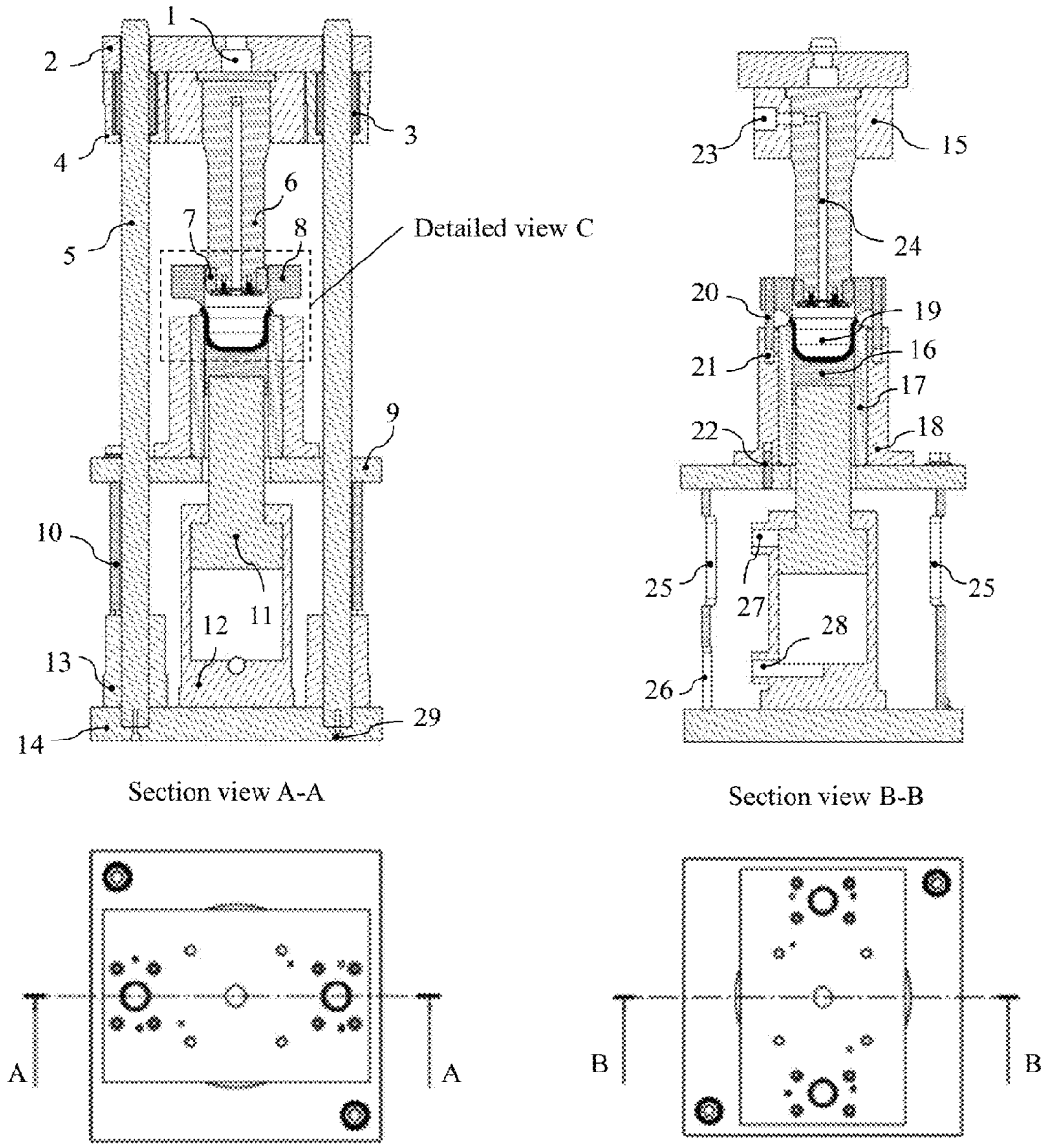
FIG. 3, displays cross section views of designed hydro ironing tooling.

Although using a double action press would ease the process and lower the number of tooling components, the hydro ironing tooling (FIG. 2) was designed so that it could be used in an ordinary workshop with a simple single action press. As shown in FIG. 3, the tooling is connected through prepared place for the die stem 1 in the upper shoe 2. The mandrel is fixed on the upper shoe by mandrel holder 15.

This shoe is guided by two linear ball bearings 3 which are fixed in position by two housings 4 on the upper shoe. The hydro ironing die 17 is press fitted in a part named "Die Reinforce" 18 and so was the ironing ring 7 on the mandrel 6, to reduce elastic deformation through the Hydro ironing process. The ironing die and Die Reinforce were set on the middle shoe 9.

The position of lower 14, middle and upper shoes are specified using two guide posts 5 which are positioned in the lower shoe by two guide post holders 13 and are fixed by two Allen screws placed in 14. Almost all cylindrical parts (like 5, 7 and 17) are positioned in their places using their cylindrical feature and non cylindrical parts (like 4, 13, 15 and 18) are fixed in shoes using four screws (like 32 for 4) and positioned by two pins (like 33 for 4 or 22 for 18).

A pipe 10 was used to prepare needed space between middle and lower plates to place hydraulic jack there. Some parts of it, 24 and 25, where removed as a path for outlet 27 and inlet 26 of the jack cylinder 12. The pipe between lower and middle plates is fixed using two partially threaded rods 30 and four screws 31.

Figure 4:
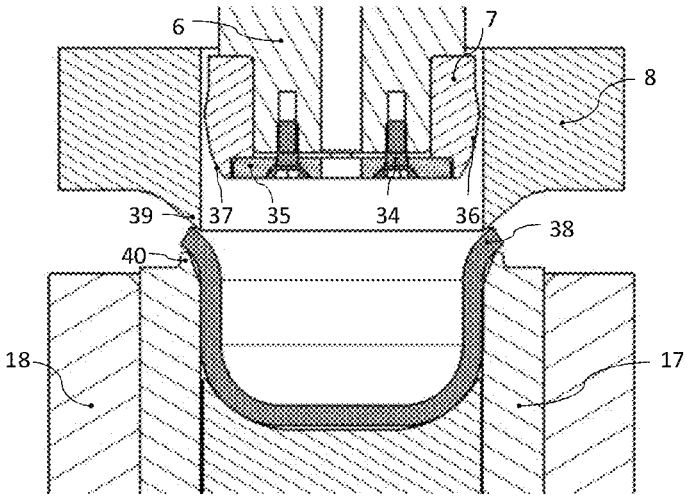
FIG. 4, displays detailed view (C) of main forming parts.

As shown in FIG. 4, the punch is fixed through a circular plate 35 and four conic Allen screws 34 on the mandrel. The conic part of common ironing rings is considered as a combination of an arc (corresponding to the cup final bottom curvature, 37) and a conic part 36.

Also, a projection like a draw bead 40 was used on ironing die for better clamping of deep drawn cup edge 38. In order to precisely put the cup holder on the cup edge, two pins 20 are press fitted in prepared places 21 on the Die Reinforce which will accurately guide the cup holder.

A pump unit was used in hydro ironing process to supply needed pressures as is shown in FIG. 5. The cup, and ring together with mandrel are shown as a $C_1$ cylinder which is set on the hydraulic jack $C_2$. The oil flow to $C_1$ and $C_2$ would be controlled by $S_1$ and $S_2$, respectively. Also, the pressure of both $C_1$ and $C_2$ can be monitored and adjusted independently by $G_1$ and $G_2$, and $R_1$ and $R_2$, respectively.

Figure 6:
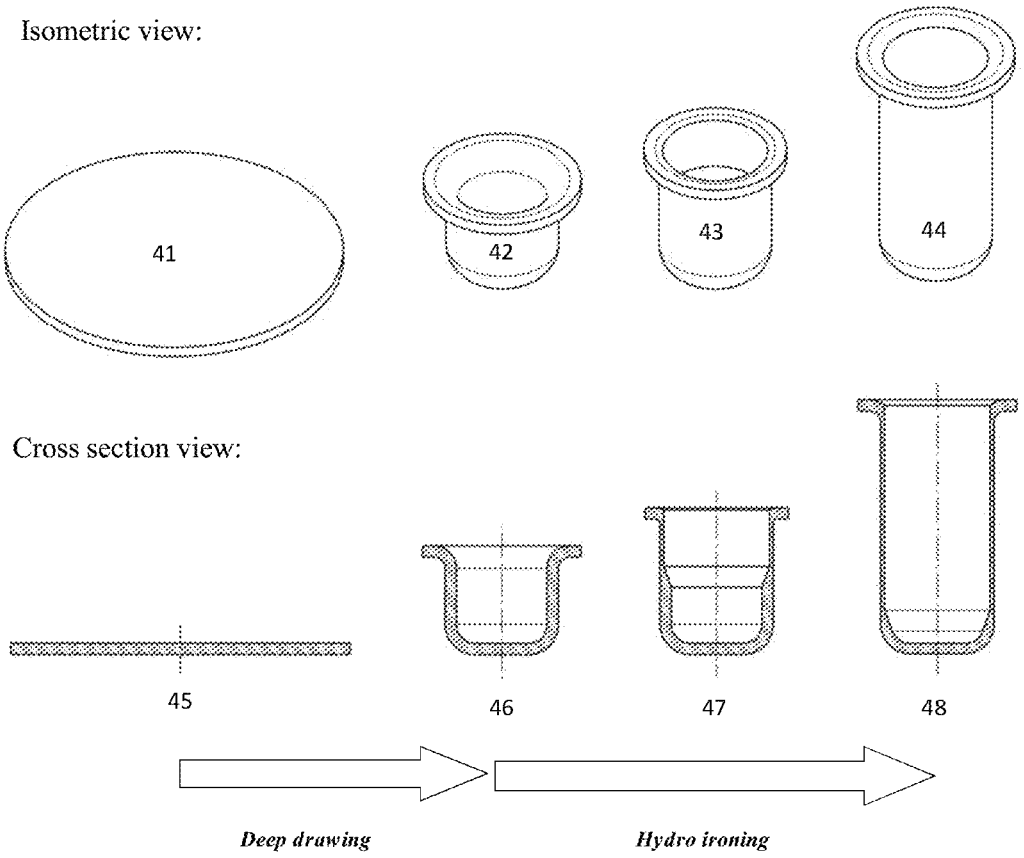
FIG. 6, displays schematic deformation of products through deep drawing and hydro ironing processes.

Using an automatically controlled hydraulic circuit would drastically enhance speed of the process. Also, if the gap between cup holder 8 an mandrel 6 is sealed at the beginning of the process (FIG. 1), the initial specimen can be a plane blank 41 which is first deep drawn 42 (sheet hydro forming) and then hydro ironed 44 consequently in the same die (FIG. 6).

Furthermore, as there is outflow during the forming step, low flow components can be chosen for the hydraulic circuit which is important from the initial-tooling-cost point of view.

Products:

This process is capable of producing thin-walled components, with a drastic reduction in thickness in one stage of hydro ironing. The isometric view of initial blank 41, deep drawn cup 42, deep drawn cup during hydro ironing process 43 and hydro ironed specimen 44, and their cross section (45, 46, 47, and 48, respectively) are shown in FIG. 6.

This drastic reduction in thickness (the wall thickness of 46 in comparison with 48) results in a great increase in height of products and a significant improvement in their mechanical properties like tensile strength and hardness. High dimensional accuracy and surface roughness of products are other advantages which are of the nature of ironing process as a cold forming process.

Figure 7:
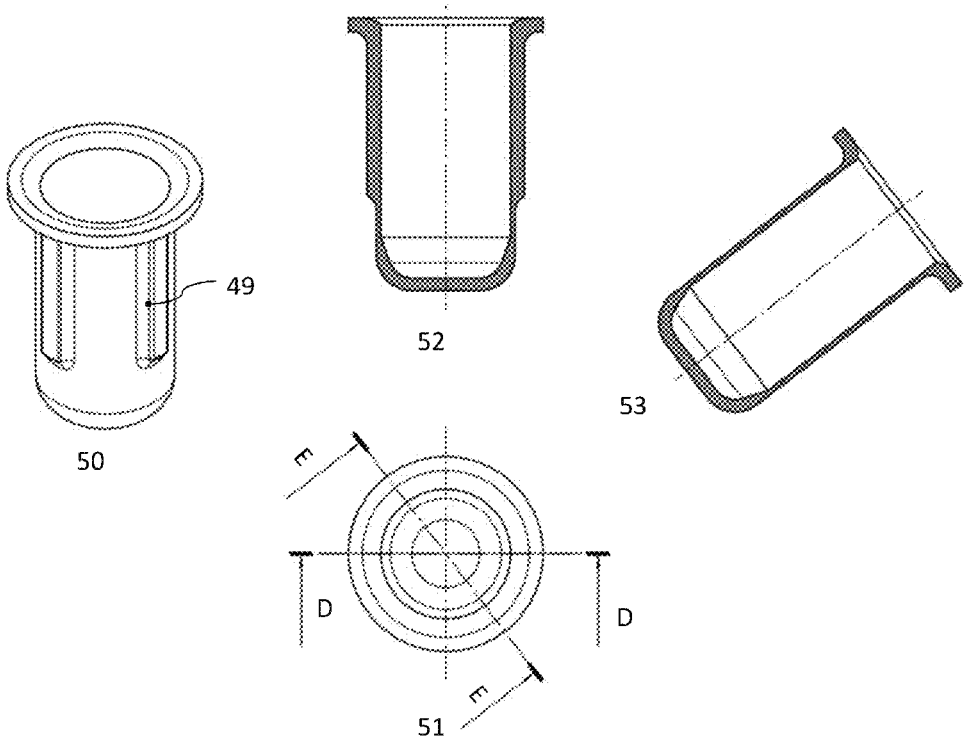
FIG. 7, displays typical indents formed on a thin-walled product.
Figure 8:
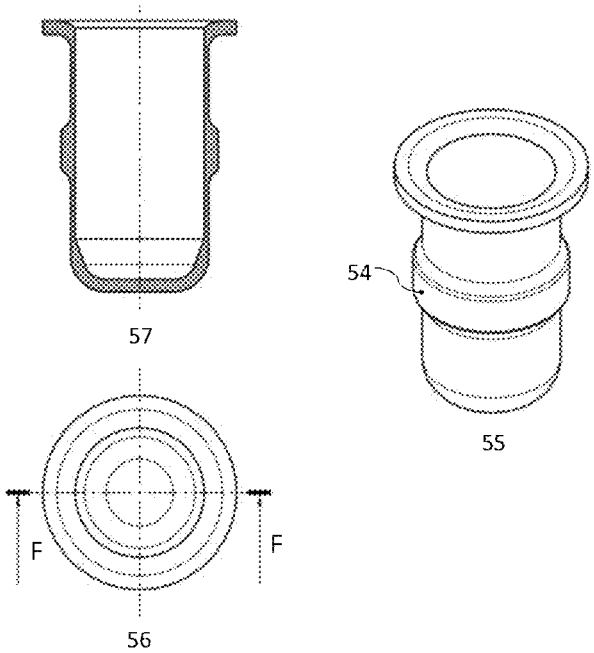
FIG. 8, displays typical indents formed on a thin-walled product.

The capability of producing thin-walled products with convexities on their outer surfaces is another application of this process. Typical indents 49 which are produced on a thin-walled cup 50, its upper view 51 and cross section views with 52 and without 53 indents (cross sections D-D and E-E, respectively) are shown in FIG. 7. Also, a typical rib 54 which is produced on the cup 55, its upper view 56 and cross section F-F 57 is shown in FIG. 8.

These features may act as any type of indents on hollow cylindrical products (like that of drum clutches of automobiles) or a replacement of curled, bulged or threaded parts of them. These applications will reduce the stages of manufacturing a product and also may provide the possibility of producing features which were hard or impossible to produce in conventional methods.

In the end this process will:

1. Increases the reduction in area by two folds and even more as compared to the conventional process.
2. Prepares the capability of using materials with low workability characteristics based on the compressive nature of the proposed method.
3. Uses fewer tooling and operations which results in reducing the manufacturing time and expenses.
4. Reduces the energy consumption and pollution
5. Reaches products with better mechanical properties like higher hardness and tensile strength due to severe plastic deformation (SPD) of workpiece.
6. Prepares the capability of adding some features like ribs, indents etc., which from assembling point of view could reduce the manufacturing cost and time.

It is understood that the above description and drawings are illustrative of the present invention and that changes may be made in materials, design and method steps without departing from the scope of the present invention as defined in the following claims.

The invention claimed is:

1. A 3d Hydro ironing tool comprising:

An upper shoe, a middle shoe and a lower shoe, a die stem, wherein said tool is attached to said upper shoe via a place holder for said die stem; furthermore a mandrel is fixed to said upper shoe via a mandrel holder; a position of said upper, middle and lower shoes is adjusted and defined via two guide posts (preferably cylindrical posts) that are located in and fixed to said lower shoe by two post holders and screws or any connecting means capable of fixedly and tightly holding and securing said two posts to said lower shoe and keep them in place; wherein said two post holders are connected to said lower show and said two posts pass through and along a length of said two post holders; wherein said two posts are located parallel to and on either side of said mandrel keeping said upper, lower and middle shoes parallel to each other; wherein said mandrel moves up and down and is guided and adjusted in place, by two linear ball bearings located around said two posts and fixed in position by their respective housings in said upper shoe; wherein said housings are fixedly attached to said upper shoe and face said central shoe; said tool further comprises a die reinforce set attached and fixedly connected to said middle shoe having comprises two pins press fitted in prepared places in order to accurately guide a cup holder, wherein a hydro ironing die is also press fitted inside said die reinforce set on said middle shoe, and wherein an ironing ring is also press fitted in said mandrel, reducing elastic deformation through a hydro ironing process; said tool further comprises: a pump unit, first and second switches; wherein said pump unit controls flow of oil inside said drawn cup as well as a predetermined first and second pressures forces on an inside and outside surface of said drawn cup, and wherein said first and second switches open and close an inlet and outlet for said pump unit adjusting said first and second predetermined pressures as needed.

2. A 3D hydro ironing process comprising the steps of:

placing a deep drawn cup in a die; wherein an ironing ring is placed and set on an edge of said drawn cup, where said cup edge is held by a holder; then a loader (attached to a jack rod) applies an axial constant preset force on a bottom of said drawn cup while a hydrostatic oil is pressure is applied to an inner surface of said drawn cup; then said ironing process starts from said cup edge; at this step said oil is forced into and inside said drawn cup via a central inlet through a mandrel therefore eliminating a need for sealing of said oil and having a containing chamber; at this point a pressure inside said drawn cup reaches to a first predetermined pressure wherein said pressure at a ring-cup interface prevents said oil from leakage; then said ring establishes a pressing contact from said cup edge into said inner surface of said drawn cup and moves downwards towards said bottom of said drawn cup and touches said bottom, meanwhile said loader applies a constant force which is defined by a second predetermined pressure on an outside surface of said drawn cup keeping it in place; at this step said ring is unloaded and comes out of said drawn cup while said first predetermined pressure is still present inside said drawn cup; then said loader returns back to its original place and therefore expels a drastically thin-walled formed specimen.

* * * * *